US010119758B2

(12) United States Patent
Yagoobi et al.

(10) Patent No.: US 10,119,758 B2
(45) Date of Patent: Nov. 6, 2018

(54) DRYING USING PHASE CHANGE MATERIAL (PCM)

(71) Applicant: Worcester Polytechnic Institute, Worcester, MA (US)

(72) Inventors: Jamal Yagoobi, Hopkinton, MA (US); Yasmin Khakpour, Worcester, MA (US)

(73) Assignee: Worcester Polytechnic Institute, Worcester, MA (US)

( * ) Notice: Subject to any disclaimer, the term of this patent is extended or adjusted under 35 U.S.C. 154(b) by 486 days.

(21) Appl. No.: 14/726,803

(22) Filed: Jun. 1, 2015

(65) Prior Publication Data

US 2015/0345861 A1 Dec. 3, 2015

Related U.S. Application Data

(60) Provisional application No. 62/005,447, filed on May 30, 2014.

(51) Int. Cl.

| | |
|---|---|
| ***F26B 3/32*** | (2006.01) |
| ***F26B 3/18*** | (2006.01) |
| ***F26B 13/26*** | (2006.01) |

(52) U.S. Cl.

CPC ..... *F26B 3/18* (2013.01); *F26B 13/26* (2013.01)

(58) Field of Classification Search

CPC .. F26B 3/18; F26B 13/06; F26B 13/08; F26B 13/14; F26B 13/183; F26B 13/26;

(Continued)

(56) References Cited

U.S. PATENT DOCUMENTS

| | | | | |
|---|---|---|---|---|
| 4,202,113 | A | 5/1980 | Kankaanpaa | |
| 2015/0114592 | A1* | 4/2015 | Ide | F28D 20/023 165/10 |

FOREIGN PATENT DOCUMENTS

| | | | |
|---|---|---|---|
| DE | 102005041223 | * | 3/2007 |
| EP | 0668396 | * | 8/1995 |

(Continued)

OTHER PUBLICATIONS

DE102005041223A1; retrieved Jun. 22, 2017.*

(Continued)

*Primary Examiner* — John McCormack
(74) *Attorney, Agent, or Firm* — Armis Intellectual Property Law, LLC

(57) ABSTRACT

Drying a planar substrate such as paper sheet goods for packing materials includes layering a phase change material (PCM) on a substrate, in which the substrate has a moisture content and adapted for moisture removal to form a planar medium. A drying process disposes the substrate adjacent to a plurality of rollers and heat the layered substrate to a predetermined temperature based on a specific heat of the PCM. The rollers advance the layered substrate in series through pocket ventilation regions between the heat transfer elements, such that the pocket ventilation regions permit drying of the substrate enhanced by the specific heat of the temperature sensitive material. Upon drying, the layered substrate forms the planar medium suitable for use as a packing medium or other suitable application. The pocket ventilation regions are based on the PCM to facilitate drying and eradication of moisture from the paper planar substrate.

16 Claims, 4 Drawing Sheets

(58) Field of Classification Search
CPC ..... F28D 20/02; F28D 20/023; F28D 20/026; F28D 20/028; B32B 27/10; B32B 29/002; H01L 21/385; H01L 21/02263
USPC ..... 34/345, 348; 162/70, 359.1
See application file for complete search history.

(56) References Cited

FOREIGN PATENT DOCUMENTS

| | | |
|---|---|---|
| EP | 668393 B1 | 6/2002 |
| SU | 344058 A1 | 7/1972 |

OTHER PUBLICATIONS

EP0668396A1; retrieved Jun. 22, 2017.*
Translation of DE102005041223A1; retrieved Jun. 22, 2017.*
Translation of EP0668396A1; retrieved Jun. 22, 2017.*
International Search Report for PCT/US2015/033482; dated Sep. 17, 2015; 2 pages.

* cited by examiner

DRYING USING PHASE CHANGE MATERIAL (PCM)

RELATED APPLICATIONS

This patent application claims the benefit under 35 U.S.C. § 119(e) of U.S. Provisional Patent App. No. 62/005,447, filed May 30, 2014, entitled "DRYING USING PHASE CHANGE MATERIAL (PCM)," incorporated by reference in entirety.

STATEMENT REGARDING FEDERALLY SPONSORED RESEARCH AND DEVELOPMENT

This invention was made with government support under grant No. NSF CBET 1133353, awarded by the National Science Foundation. The government has certain rights in the invention.

BACKGROUND

Phase-Change Materials (PCMs) are materials having a high heat of fusion which, by melting and solidifying at a certain temperature, are capable of storing and releasing large amounts of energy. Heat is absorbed or released when the material changes phase from solid to liquid or liquid to solid.

SUMMARY

A PCM employed for drying a moist, porous medium facilitates fabrication and construction of paper-based product such as packaging materials. Drying of moist, porous materials is common for various articles where water is employed to hydrate a substance prior to drying for generating a finished medium. Configurations herein employ PCM (Phase Change Materials) in the drying process of moist, porous materials. A layered PCM-based process as disclosed herein substantially reduces drying time associated with production of such substrates. For example, paper based packaging materials are often arranged from a liquid or moist layer form, and dried as a planar sheet to form a finished medium having strength and resiliency. Such a planar based process lends itself well to the methods herein.

A method for drying a planar substrate such as paper sheet goods for packing materials includes layering a temperature sensitive material such as a phase change material (PCM) on a substrate, in which the substrate has a moisture content and is adapted for moisture removal to form a planar medium. A drying process disposes the substrate adjacent to a plurality of heat transfer elements, and heat the layered substrate to a predetermined temperature based on a specific heat of the temperature sensitive material. The heat transfer elements, such as rollers, advance the layered substrate in serial communication through pocket ventilation regions between the heat transfer elements, such that the pocket ventilation regions permit drying of the substrate enhanced by the specific heat of the temperature sensitive material. Upon drying, the layered substrate forms the planar medium suitable for use as a packing medium or other suitable application. The pocket ventilation regions are defined by a travel distance between the rollers for allowing temperature ranges corresponding to the PCM to facilitate drying and eradication of moisture from the paper planar substrate.

Conventional approaches have not investigated the effect of phase change material (PCM) on drying of moist porous medium. The current numerical approach investigates the transport characteristics associated with the drying process of a paper sheet in the presence of a layer of PCM. Configurations herein demonstrate the effect of adding a PCM layer within the paper sheet on the moisture removal and thus, on the drying process. The disclosed approach permits drying by utilizing the latent-heat of fusion associated with the PCM to improve the energy efficiency of paper drying process. To avoid any unnecessary complications, a very simple conventional paper drying process is considered where there is no felt, impinging air jets, or infrared emitters present. Besides the innovative concept of paper drying with layered PCM, this approach also provides a fundamental understanding for drying of a smart packaging paper which contains PCM to better control the temperature of the content inside the package.

The drying process involves the evaporation of liquid moisture inside the paper sheet due to its exposure to the heated drums as well as the hot air. The paper sheet is heated due to its contact to the heated cylinders from one side while it is exposed to ambient air on the other end in the process known as "pocket air ventilation" which is defined as the space in the dryer section between two adjacent cylinders, in case of single-tier system, or between three cylinders, in case of a two-tier system.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

In an example configuration depicted further below, the temperature sensitive material is a Phase Change Material (PCM) having a specific heat for releasing thermal energy for drying the hydrated substance. The specific heat of the PCM layer is based on the substrate material such as to release latent heat at an optimal time in the drying process of the substrate.

In an alternate arrangement, such production forms a second layer of the hydrated substance with the temperate sensitive material disposed between the layers, thereby forming a "sandwich" of substrate material around the PCM layer. The resulting substrate forms a planar material that is sufficiently rigid for forming a packaging material, or other purposes as discussed below.

Figure 1:
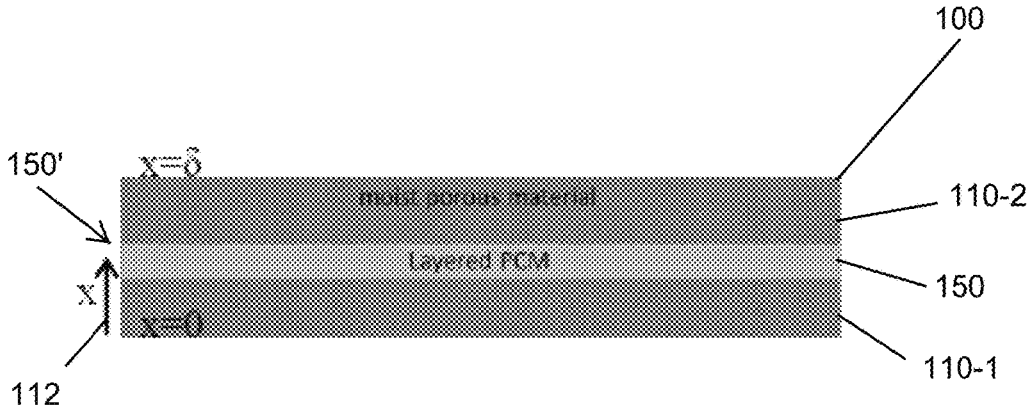
FIG. 1 is a schematic diagram of the a substrate suitable for use with configurations described herein.

Drying of a planar substrate comprising hydrated or moist porous materials occurs by passing the sheet defining the substrate along a series of heated rollers, alternating sides so that the heat of the rollers applies to both sides of the substrate. FIG. 1 is a schematic diagram of a substrate suitable for use with configurations described herein. In the configurations that follow, a paper fabrication process illustrates the use of the PCM layer 150 in conjunction with a paper sheet as the substrate 110. Upon drying, the substrate 110 forms the dried medium, in this case a paper sheet suitable for uses such as cardboard and packing materials, for example. Referring to FIG. 1, a substrate 100 such as a moist porous material is layered with a phase change material (PCM) 150. The PCM may be layered, deposited, or applied on one side of the substrate 110-1, or may be "sandwiched" between multiple layers 110-1, 110-2 (110 generally). A thickness 112 (defined as "x") of the layered substrate 100 defines a distance from a heat source as the substrate, typically a planar sheet, is advanced between rollers or other heating elements during the drying process.

The energy for the drying process comes from saturated steam injected under pressure into the cylinders. The steam pressures in conventional dryers range from 0-1000 kPa (0-145 psi). As the steam condenses inside of the dryer drum, the latent heat of evaporation is released. The heat is transferred through the condensate layer and dryer shell to the paper on the outside surface. During the pocket ventilation, the majority of evaporation occurs from the substrate. For the efficient drying of paper, it is preferable to remove the water vapor from around the web to increase the driving force for evaporation. Therefore, not only the surface temperature is important in the water removal from the paper sheet, the drying performance is dependent on the rate of water removal to the hot and dry air. For instance, if the movement of air in the pockets is too low or close to stagnation, higher temperatures in the pockets does not help in improving drying rate. There should be sufficient airflow in the pockets for efficient drying.

Figure 3A:
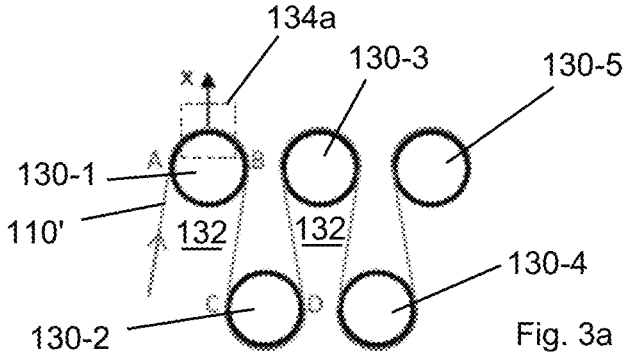
FIGS. 3*a*-3*d* are a side view of a transport apparatus showing the phases of drying the substrate of FIG. 1.
Figure 3B:
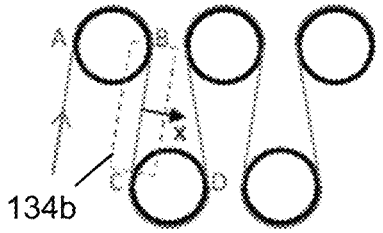
Figure 3C:
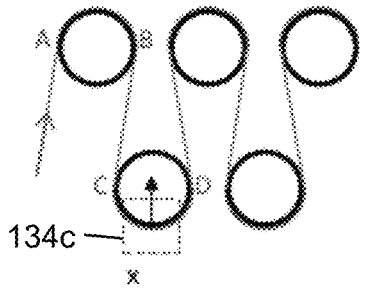
Figure 3D:
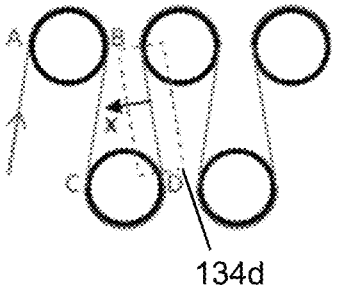

In the following stage and while the paper sheet 110' (FIG. 3*a*) is travelling to the subsequent cylinder, the sheet is exposed to ambient air from both sides. The contact heating on the subsequent cylinder is switched to the opposite end of the paper sheet 110' while the other end is now being exposed to the ambient air.

Another example provides felt based substances to the porous medium to enhance the drying process. Felts support the web structure typically formed by the porous medium and enhance the heat transfer for drying as well as strengthen and improve the finished product. In a particular configuration, the approach herein provides method for forming a planar material by forming a hydrated substance on a planar surface, and applying a temperature sensitive material on the hydrated substance forming a layer having parallel planar structure to the hydrated substance. The hydrated substance may be a liquid or pulp-like form, and is sufficiently viscous or structured to hold a planar shape alone or with a felt base. The method forms the substrate 110 by drying the hydrated substance via the application of heat from the temperature sensitive material 150, in which the substrate has a generally planar shape.

The following steps illustrate the concept of drying process in the presence of a layer of PCM.

The PCM layer absorbs heat at its contact interface with the paper sheet 110' during the heating period and undergoes solid-to-liquid phase change. During the pocket ventilation process, the PCM releases the stored heat due to the exposure of the sheet to the lower temperature, enhancing the water evaporation from the paper sheet. The pocket ventilation regions are selected based on a travel time of the layered substrate 110 between the heating elements and on a temperature range experienced by the layered substrate during travel through the pocket ventilation region While releasing heat to the paper sheet, the PCM 150 solidifies during the pocket ventilation process. In the example arrangement, the layered temperature sensitive material is a phase change material (PCM) having a specific heat greater than a specific heat of the substrate, and the heat transfer elements are heated rollers for advancing the layered substrate in succession along the heated rollers. Alternate substances may be layered for increasing the efficiency of the drying process. The example configuration includes selecting the phase change material based on a temperature at which the PCM transitions to a solid for extracting latent heat from the PCM The previous three steps repeat as the sheet goes to the next cycle.

Figure 2:
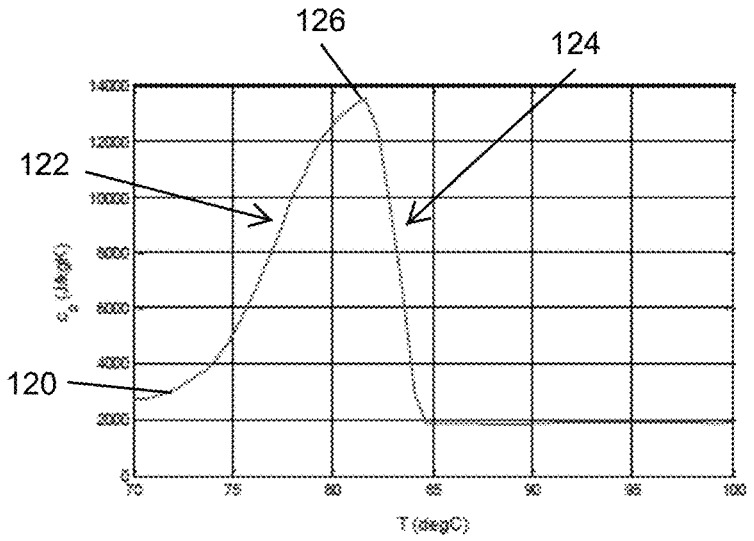
FIG. 2 shows a melting curve of a Phase Change Material (PCM) defined by a layer in FIG. 1.

Note that the PCM properties must be tuned to the corresponding drying operating conditions. The latent heat of melting of PCM is represented by the temperature dependent specific heat presented in FIG. 2. Referring to FIGS. 1 and 2, the graph line 120 depicts the latent heat in the PCM 150, showing a sudden increase 122 followed by a sudden drop 124 in the value of specific heat corresponds to the melting of the PCM 150. The temperature range at which the melting occurs depends on the type of the PCM 150. Since one objective is to demonstrate the versatility of using PCM layer 150, an arbitrary PCM melting temperature range is selected. The PCM peak temperature, Tpeak PCM, 126 is tuned to the temperature of the paper sheet defining the layered substrate 110 at the end of the heating cycle. In the present work, a PCM with melting temperature of $T_{peak,PCM}$=85° C. is selected. Finally, the operating conditions of the dryer section considered here are also selected for the sole purpose of illustration of the concept. The properties of the paper and PCM layer are given in Table 2.

FIGS. 3*a*-3*d* are a side view of a transport apparatus showing the phases of drying the substrate of FIG. 1. The drying process involves the evaporation of liquid moisture inside the paper sheet due to its exposure to the heated drums as well as the hot air. The different stages of drying are presented schematically in FIGS. 3*a*-3*d*. The paper sheet 110' is heated upon contact with heated cylinders 130-1 . . . 130-5 (130, generally) from one side while it is exposed to ambient air on the other end. In the following stage and while the paper sheet is travelling to the subsequent cylinder, the sheet 110' is exposed to ambient air 132 from both sides. The contact heating on the subsequent cylinder is switched to the opposite end of the paper sheet while the other end is now being exposed to the ambient air.

The approach shown in FIGS. 3*a*-3*d* address the drying process across the paper sheet 110' independently of the lateral variation of moisture and vapor content. That in effect requires the model to be translated into the reference frame moving with the paper sheet 110' along the cylinders 130 which implies that the thermal and mass transfer boundary conditions should be represented as time-dependent parameters as illustrated in FIGS. 3*a*-3*d*, respectively. The boundary condition of the drying segment 134*a*, 134*c* for the cases in FIGS. 3*a* and 3*c*, respectively, is contact heating (x=0) and convection (x=δ) while in FIGS. 3*b* and 3*d*, a convection boundary condition is applied at both ends of the paper sheet, shown as 134*b*, 134*d*. The temporal duration of each boundary condition is determined by the geometrical and operating conditions of each case as will be discussed further below. In the example arrangement, the substrate 110 is a hydrated porous medium such as paper, and is responsive to the heat transfer elements for eradicating water from the substrate to form the planar medium 101.

The governing equations for the mass and energy balance through the sheet thickness are as follows. The mass balance equation is stated as:

$$\frac{\partial M}{\partial t} = -\frac{\partial J_w}{\partial x} - \frac{\partial J_v}{\partial x} \tag{1}$$

The transport of liquid water inside the paper sheet is modelled through Darcy's law which governs the capillary pressure distribution inside the porous moist sheet, $$J_w = \frac{K}{v_w}\frac{\partial P_{ca}}{\partial x} \tag{2}$$

The capillary pressure, Pca, is obtained from an empirical correlation:

$$P_{ca}=0.84\times10^5 s^{-0.63} \tag{3}$$

where 0<s<1 is the liquid saturation inside the porous medium and can be related to the moisture content through the following equation, $$s=f(MC) \tag{4}$$

This correlation determines the capillary pressure in wood as a function of saturation. It was developed with consideration of both experimental data and a mechanistic model and includes an irreducible saturation level of approximately 0.1, below which liquid flow was no longer possible. An additional expression for capillary pressure in paper needs to be developed, since the porous structure of wood is not the same as the structure of paper. The transport of vapor phase inside the paper sheet is governed through Fick's law:

$$J_v = -\frac{D_{app} MW_v}{1-y_v}\frac{\partial C_v}{\partial x} \tag{5}$$

where $D_{ap}$ is the apparent mass diffusivity of water vapor and is related to its molecule diffusivity through the following equation, $$\frac{D_{ap}}{D_v} = \frac{\Phi}{\alpha}\varepsilon^m(1-s)^n \tag{6}$$

where $\Phi/\alpha$ is the ratio of the pore shape factor to the tortuosity factor. In this model, the values of of $\Phi$ and n are chosen as 1

The molecular diffusivity, Dv, is related to the operating temperature through:

$$D_v = A_1\frac{r^{1.5}}{P_{atm}} \tag{7}$$

-continued where $A_1 = 8.076\times10^{-4}\left(\mathrm{kg}\cdot m/s^3 K^{1.5}\right)$.

The energy transfer inside the paper sheet is governed by the following energy balance equation, $$\rho_{sh} cp_{sh}\frac{\partial T}{\partial t} = -\frac{\partial q''}{\partial x} - \frac{\partial(J_w H_w + J_v H_v)}{\partial x} \tag{8}$$

where $$q'' = -k_{eff}\frac{\partial T}{\partial x} \tag{9}$$

The thermal mass of the paper sheet, $\rho_{sh}$, $cp_{sh}$, is calculated based on the temporal and spatial distribution of liquid and vapor content as well as the properties of the dry paper sheet and its porosity:

$$\rho_{sh} cp_{sh}=\rho_f cp_f(1-\varepsilon)+\rho_w cp_w S\varepsilon \tag{10}$$

$$k_{eff}=k_f(1-\varepsilon)+k_w S\varepsilon+k_a(1-\varepsilon)\varepsilon \tag{11}$$

where ε is the sheet's porosity which is assumed to be constant.

In the presence of PCM layer (see FIG. 1), the energy equation for the PCM layer is defined as:

$$\rho_{PCM} cp_{PCM}\frac{\partial T}{\partial t} = k_{PCM}\frac{\partial^2 T}{\partial x^2} \tag{12}$$

and at the two interfaces of the paper and PCM layer, the following condition is valid: $T_{paper}=T_{PCM}$. It should be noted that the thermal contact resistance between the paper and PCM layer is neglected. While the thermal conductivity of both the paper and the PCM are assumed to be constant with temperature, the specific heat of the PCM is defined as a function of temperature illustrated in FIG. 2 and included in the numerical code as a forth order polynomial function of T.

The moisture evaporation is represented through the following boundary condition at the two ending nodes of the paper sheet 110' (FIG. 1).

$$J_{v,o} = k_m\left(\frac{P_v - P_{va}}{P_{atm}}\right)\left(\frac{MC|_{x=th_{sheet}}}{MC_{init}|_{x=th_{sheet}}}\right) \tag{13}$$

where the mass transfer coefficient, km, is determined from the Chilton-Colburn form of the Reynold's analogy. The last term in Eq. (13) is an arbitrary factor included to represent reductions in moisture available for evaporation at the free surface during drying, since evaporation relationships available in the literature are based on the presence of a fully wetted surface. Use of an adjusted evaporation rate to reflect reductions in evaporation from the paper web during drying is similar to previous studies which forcibly decreased the sheet evaporation rate at pre-determined critical moisture content in order to simulate the falling rate period of drying. The vapor pressure, $P_v$ is calculated using an exponential curve fit:

$$P_v = A_2\exp\left(-\frac{B}{T}\right) \tag{14}$$

-continued where $$A_2 = 4.0309 \times 10^{10}(Pa) \text{ and } B = 4832.16(K).$$

The heat exchange on the heated cylinder is estimated through the thermal contact conductance equation:

$$q'' = h_i(T_{cyl} - T) \tag{15}$$

where the following empirical expression is used for the thermal conductance, hi $$h_i = -20.13 + 19.87 \times \ln(P) + \frac{21.00}{BW} + 97.70\omega^2 \ln(P) - \frac{8.54\omega^{5/4}}{BW} + 188.65\omega^{3/2} \tag{16}$$

where 0.68<P<328.81 kPa, 0.084<BW<0.313 kg/m2, 4.8%<ω<60%, Tavg=85° C. The contact conductance increases with increasing pressure, increasing moisture levels, and decreasing sheet basis weight. It is assumed that the temperature of the heated cylinder, Tcyl, remains constant due to its continuous exposure to the superheat steam. On the opposite side of the paper sheet where it is exposed to convective air flow, the following convection boundary condition is applied:

$$q''_{conv} = h_a(T - T_a) \tag{17}$$

The convection heat transfer coefficient is estimated through turbulent flow over cylinders 130 and flat plate, respectively, for the portion pertinent to the paper sheet on the heated drums and traveling in between. The boundary conditions presented so far must change in time to represent the motion of the paper sheet along the heated cylinders and within the pocket-drying region. The following two equations describe the temporal variation of the evaporation mass flux at the boundaries at the two ends of the paper sheet, $$\begin{cases} f_1(t) = 0, & 0 < t < t_h \\ f_1(t) = J_{vo}, & t_h < t < t_h + t_{conv} \end{cases} \tag{18}$$

$$\begin{cases} f_2(t) = J_{vo}, & 0 < t < t_h \\ f_2(t) = J_{vo}, & t_h < t < t_h + t_{conv} \end{cases}$$

where $t_h$ and $t_{conv}$ are times for the paper sheet being on the cylinder and traveling in between (pocket-drying region). This equation implies that the vapor can be transported to the ambient air only on the side exposed to it while the other end remains adiabatic. Note that the boundary condition is switched between the two ends to represent the travel of the paper sheet over and under subsequent cylinders. The temporal variation of the thermal boundary condition is analogous to Eq (18). with the sole difference of adiabatic boundary condition on the side contacting the cylinder being replaced by the thermal conductance equation, Eq. (16) to account for the heat exchange between the cylinders and the paper sheet.

Figure 4:
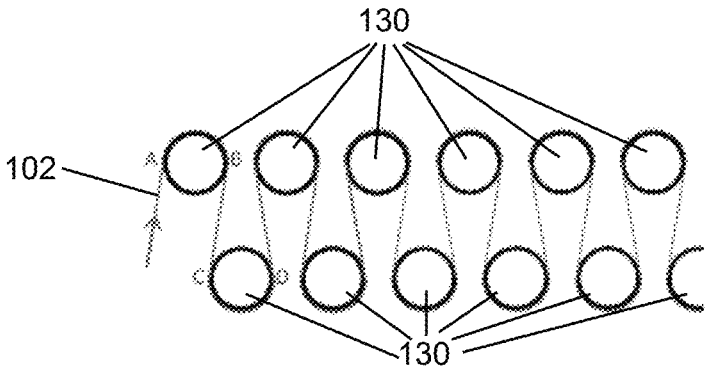
(Prior Art) Fig. 4
FIG. 4 shows a conventional arrangement of drying rollers.

FIG. 4 shows a conventional arrangement of drying rollers. Conventional dryers used widely in the pulp and paper industry include rollers 130 defined by a series (30-100 units) of cylindrical cast iron dryer drums. These drums are in close proximity and are continuously heated by the superheat steam which serves as the energy required to extract the moisture from a conventional paper sheet 102. In what follows, the results of paper-sheet drying under this conventional setting is disclosed and compared against the case with the disclosed PCM layer 150.

Figure 5:
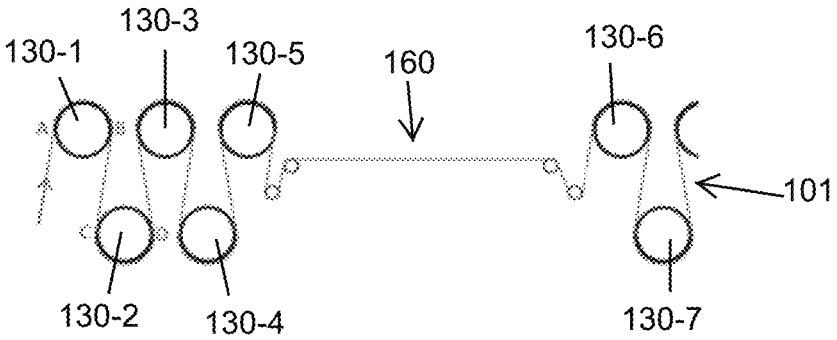
FIG. 5 shows an arrangement of rollers defining heating elements including pocket ventilation regions as defined herein.

FIG. 5 shows an arrangement of rollers defining heating elements including pocket ventilation regions as defined herein. FIG. 5 depicts a periodic heating which exploits the advantage of PCM latent heat of melting during the pocket ventilation. In the Periodic Heating Arrangement, a number of heated cylinders are followed by a pocket ventilation 160 segment defined by an extended length of the paper sheet 110' being exposed to the ambient air.

Figure 6:
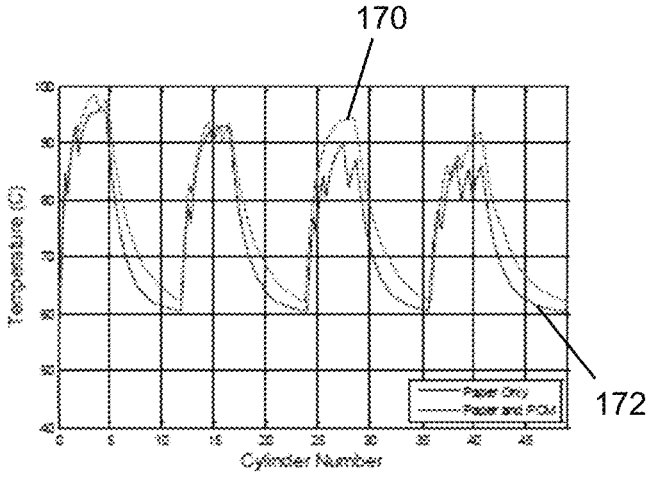
FIG. 6 shows a graph of substrate temperature during drying.

As described earlier, in the conventional arrangement of paper-drying, the paper sheet undergoes a continuous series of heating cylinders 130 and ventilation processes between the rollers. In this setting, every heated cylinder 130 is followed by a duration of ventilation with the corresponding times obtained from the operating velocity and the length of each phase. FIG. 6 illustrates the variation of the sheet temperature and moisture content in the presence and absence of PCM layer. It is observed that under this set of operating conditions, using a conventional ventilation duration/distance between the rollers 130, the difference between the moisture content of the two cases of paper with and without the PCM 150 deviates by a small degree. Therefore, marginal benefits may be obtained by using the PCM layer. The slight increase in moisture content at the early stages of the drying process, such as when Cyl<3, is due to the condensation of the initial vapor content in the paper sheet since its initial temperature, $T_{init}$, is lower than the ambient temperature.

Figure 7:
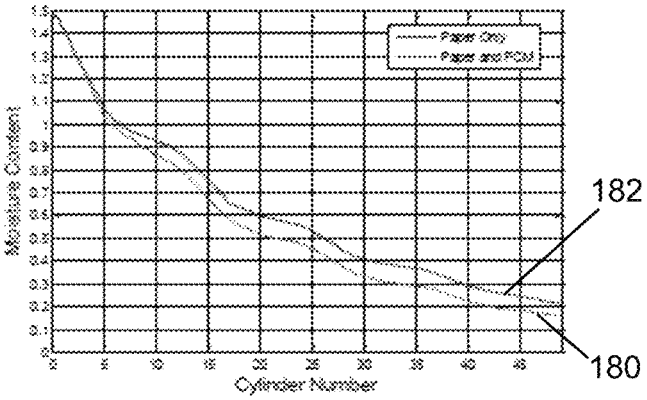
FIG. 7 shows moisture content during drying of the substrate of FIG. 1.

FIG. 6 shows a graph of substrate temperature during drying, and FIG. 7 shows moisture content during drying of the substrate of FIG. 1. The variation of temperature and moisture content for the periodic heating arrangement is presented in FIG. 6. As mentioned before, the paper sheet 100 goes through the heating process over the first 5 cylinders followed by an extended length of pocket ventilation 160 which is equal to the time if the paper sheet had to pass over additional 7 cylinders, in the example configuration. The duration and/or distance of the extended pocket ventilation 160 may be adjusted, in alternate configurations, to vary the temperature of the substrate 110 based on the latent heat of the PCM, as depicted in FIG. 2. It is observed that during the heating period (e.g. 1<Cyl<5), the temperature rise is higher for the case of paper with PCM layer. Also, during the pocket ventilation, the configuration with the PCM layer 150 encounters a slower decline of temperature so as to approach temperatures that are higher than the paper-only counterpart at the end of the inter-roller ventilation cycle. This is attributed to the availability of latent heat of melting in the PCM layer, quantified as increased specific heat of the composite material, which results in a larger thermal mass (i.e. acting as a heat source). As the result of this delay in the temperature drop, the sheet temperature in the presence of PCM remains superior to that of paper-only case which is the primary reason for a faster drop of the moisture content in the paper sheet, shown in FIG. 7.

The pocket ventilation regions 160 occupy a distance based on a temperature fluctuation for permitting release of latent heat defined by the specific heat of the phase change medium 150. In a particular configuration, the pocket ventilation region is defined by a distance corresponding to seven rollers. Alternate arrangements may dispose a carrier layer 150' (FIG. 1) in communication with the substrate, in which the carrier layer 150' is impregnated with the PCM. In one example, the carrier layer 150' is a felt material configured to absorb the PCM. Alternate configurations of a web or planar material may be employed for concentrating a suitable quantity of the PCM layered with the substrate layers 110.

The configuration with the PCM layer 150 shows a modest increase in the moisture content generated by the condensation due to the slightly slower temperature rise during the first heating cycle. As illustrated in FIG. 6, the average temperature of the paper sheet and PCM substrate 110 case, shown as line 170, exceeds the paper-only counterpart 102, shown as line 172, in the first heating cycle and remains superior during the rest of the heating cycles. In addition, the case without the PCM layer appears to have a more dramatic decline of the temperature at each ventilation period where it is exposed to the ambient air 132 for an extended period of time. This is attributed to its lack of thermal mass compared to the case with PCM layer 150. As a consequence, when the paper reaches the end of each period (end of its cooling cycle), the cooling effect of the ambient air prevails over the heating provided by the heated cylinder which results in the continuous decline of the temperature until it reaches the ambient air temperature, Ta=60. At this point, the cooling performance by the ambient air becomes effectively zero (T−Ta=0) and the sheet temperature resumes its ascent as the heating cycles begins. This is a contrasting finding, especially when compared to the continuous heating arrangement where the pocket ventilation occurs only on one side of the paper sheet on the unheated cylinders, depicted in FIG. 4. This implies that when the paper sheet substrate 110' is exposed to an extended unheated period, the case with no PCM 150 is more susceptible to a decline of temperature and eventual reduction in moisture removal efficiency. As the result of higher overall temperature, the paper sheet with PCM layer encounters a more dramatic reduction in its moisture content over time, as shown by PCM line 180. At the end of the drying process the moisture removal efficiency is improved by 15% over the conventional paper 102 case, shown as line 182.

In the disclosed approach, the transport characteristics associated with the drying process of a paper sheet in the presence and absence of a layer of phase change material (PCM) was investigated. The numerical solution of the mathematical model provides the moisture and temperature profiles within the paper sheet in the presence and absence of PCM. Two different arrangement of the heated cylinders and air ventilation pockets have been introduced. The results demonstrate that drying can be enhanced by introducing the PCM layer 150 to improve moisture removal from the porous paper sheet.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. In a system for forming a planar medium through moisture eradication from a hydrated, formed planar substrate, a method for drying the planar substrate, comprising:

layering a temperature sensitive material on a substrate, the substrate having a moisture content and adapted for moisture removal to form a planar medium, the temperature sensitive material selected based on a temperature at which the temperature sensitive material transitions to a solid for extracting latent heat from the temperature sensitive material for expelling the moisture content and accelerating drying of the substrate;

disposing the substrate adjacent to a plurality of heat transfer elements, heating the layered substrate for inducing a first phase change to facilitate a second phase change, the phase change of a first substance enhancing a phase change of a second substance, the temperature sensitive material being a phase change material (PCM) and the pocket ventilation regions occupy a distance based on a temperature fluctuation for permitting release of latent heat defined by the specific heat of the PCM.

2. The method of claim 1 wherein the first substance is a phase change material adapted for releasing latent heat for drying the substrate, the second substance defined by water in the hydrated substrate.

3. The method of claim 1 wherein the pocket ventilation regions are defined by regions of ambient air surrounding both sides of the layered substrate between areas of contact with the heat transfer elements.

4. The method of claim 3 wherein the heat transfer elements are heated rollers in contact with one side of the layered substrate.

5. A method for drying a substrate, comprising:

layering a temperature sensitive material on a substrate, the substrate having a moisture content and adapted for moisture removal to form a planar medium the temperature sensitive material selected based on a temperature at which the temperature sensitive material transitions to a solid for extracting latent heat from the temperature sensitive material for expelling the moisture content and accelerating drying of the substrate;

disposing the substrate adjacent to a plurality of heat transfer elements;

heating the layered substrate to a predetermined temperature, the predetermined temperature based on a specific heat of the temperature sensitive material; and advancing the layered substrate through pocket ventilation regions between the heat transfer elements, the pocket ventilation regions permitting drying of the layered substrate enhanced by the specific heat of the temperature sensitive material, the layered substrate forming the planar medium after drying, the temperature sensitive material being a phase change material (PCM) and the pocket ventilation regions occupy a distance based on a temperature fluctuation for permitting release of latent heat defined by the specific heat of the PCM.

6. The method of claim 5 further comprising selecting the pocket ventilation regions based on a travel time of the layered substrate between the heat transfer elements and on a temperature range experienced by the layered substrate during travel through the pocket ventilation region.

7. The method of claim 5 wherein the PCM has a specific heat greater than a specific heat of the substrate and the heat transfer elements are heated rollers for advancing the layered substrate in succession along the heated rollers.

8. The method of claim 5 wherein the heat transfer elements are rollers for advancing the layered substrate in serial communication with each of the rollers, and the pocket ventilation regions are defined by a travel distance between the rollers.

9. The method of claim 8 wherein the substrate is a hydrated porous medium responsive to the heat transfer elements for eradicating water from the substrate to form the planar medium.

10. The method of claim 5 wherein the pocket ventilation region is defined by a distance corresponding to seven rollers.

11. The method of claim 7 wherein the layering includes disposing a carrier layer in communication with the substrate, the carrier layer impregnated with the PCM.

12. The method of claim 11 wherein the carrier layer is a felt material configured to absorb the PCM.

13. An apparatus for drying a planar substrate, comprising a plurality of heat transfer elements at least one pocket ventilation region between the heat transfer elements;

a transport for disposing a hydrated planar substrate adjacent to the heat transfer elements in succession for applying heat to the substrate in a progressive linear manner; and a temperature sensitive material layered on the substrate, the temperature sensitive material selected based on a temperature at which the temperature sensitive material transitions to a solid for extracting latent heat from the temperature sensitive material for expelling the moisture content and accelerating drying of the substrate and configured for applying latent heat for drying the substrate, the temperature sensitive material being a phase change material (PCM) and the pocket ventilation regions occupying a distance based on a temperature fluctuation for permitting release of latent heat defined by the specific heat of the PCM, wherein the PCM is selected based on a temperature at which the PCM transitions to a solid for extracting latent heat from the PCM.

14. The apparatus of claim 13 wherein the dried substrate is sufficiently rigid for forming a packaging material.

15. The apparatus of claim 13 wherein the pocket ventilation region comprises a plurality of pocket ventilation regions selected based on a travel time of the layered substrate between the heat transfer elements and on a temperature range experienced by the layered substrate during travel through the pocket ventilation region.

16. The apparatus of claim 15 wherein the PCM has specific heat greater than a specific heat of the substrate and the heat transfer elements are heated rollers for advancing the layered substrate in succession along the heated rollers.

* * * * *